US007226510B2

(12) United States Patent
Miyoshi

(10) Patent No.: US 7,226,510 B2
(45) Date of Patent: Jun. 5, 2007

(54) FILM FORMING APPARATUS

(75) Inventor: Tetsu Miyoshi, Kaisei-machi (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/964,723

(22) Filed: Oct. 15, 2004

(65) Prior Publication Data

US 2005/0098103 A1 May 12, 2005

(30) Foreign Application Priority Data

Oct. 27, 2003 (JP) ..... 2003-366165

(51) Int. Cl.
*B05C 11/10* (2006.01)

(52) U.S. Cl. ..... 118/665; 118/688; 118/713; 118/712

(58) Field of Classification Search ..... 118/665, 118/688, 712, 713, 300, 612, 308, 309, 312
See application file for complete search history.

(56) References Cited

U.S. PATENT DOCUMENTS

| | | | | |
|---|---|---|---|---|
| 5,529,815 | A * | 6/1996 | Lemelson | 427/575 |
| 5,800,615 | A * | 9/1998 | Lambert et al. | 118/326 |
| 2004/0026030 | A1* | 2/2004 | Hatono et al. | 156/279 |
| 2004/0151978 | A1* | 8/2004 | Huang | 429/83 |
| 2004/0197493 | A1* | 10/2004 | Renn et al. | 427/596 |
| 2005/0115500 | A1* | 6/2005 | Vardelle et al. | 118/688 |
| 2005/0120952 | A1* | 6/2005 | Vardelle et al. | 118/715 |
| 2005/0199603 | A1* | 9/2005 | Vardelle et al. | 219/130.21 |
| 2005/0223977 | A1* | 10/2005 | Vardelle et al. | 118/663 |

FOREIGN PATENT DOCUMENTS

JP 2001-348659 A 12/2001

OTHER PUBLICATIONS

JPO Machine Translation of JP 2001-348659, submitted with Oct. 15, 2004 IDS.*

Akedo, et al., "Influence of Carrier Gas Conditions on Electrical and Optional Properties of Pb(Zr, Ti) $O_3$ Thin Films Prepared by Aerosol Deposition Method", Japanese Journal of Applied Physics, vol. 40 (2001) pp. 5528-5532, Part 1, No. 9B, Sep. 2001, The Japan Society of Applied Physics.

* cited by examiner

*Primary Examiner*—George Koch
(74) *Attorney, Agent, or Firm*—Sughrue Mion, PLLC

(57) ABSTRACT

In a film forming apparatus according to the aerosol deposition method, the thickness of a structure being formed can be controlled accurately. The film forming apparatus includes an aerosol generating part in which raw material powder is to be provided, a compressed gas cylinder and a pressure regulating part for introducing a gas into the aerosol generating part to blow up the raw material powder thereby generating an aerosol, a substrate holder for holding a substrate on which a structure is to be formed, a nozzle for spraying the aerosol generated in the aerosol generating part toward the substrate, and a sensor to be used for obtaining an amount of primary particles that have contributed to film formation by impinging on the substrate or the structure formed thereon from among the raw material powder contained in the aerosol sprayed from the nozzle.

20 Claims, 3 Drawing Sheets

FILM FORMING APPARATUS

BACKGROUND OF THE INVENTION

1. Field of the Invention

The present invention relates to a film forming apparatus for manufacturing a structure by spraying a powder on a substrate at high speed so as to deposit the powder.

2. Description of a Related Art

Recent years, in the field of the micro electrical mechanical system (MEMS), fabrication of sensors, actuators, or the like employing piezoelectric ceramic by using film formation methods has been studied in order to further integrate those elements for practical use. As one of the film formation methods, the aerosol deposition method, which is known as a technology for forming a film of ceramic, metal, etc., receives attention. The aerosol deposition method (hereinafter, also referred to as "AD method") is a method of generating an aerosol containing raw material powder and spraying it on the substrate to deposit the powder due to the collision energy at that time and form a film, which method is also referred to as spray deposition method or gas deposition method. Here, the aerosol is referred to as fine particles of a solid or liquid floating in a gas.

Japanese Patent Application Publication JP-P2001-348659A discloses an apparatus for fabricating a ceramic structure according to the aerosol deposition method. As shown in FIG. 1 of the document, in the aerosol deposition method, micro powder of the order of submicron is used as a raw material. The micro powder of the row material is provided within an aerosol generator 13, and a carrier gas such as nitrogen ($N_2$) is ejected from a compressed gas cylinder 11 via a carrier pipe 2, and thereby, the raw material powder is blown up and floats in the carrier gas to generate the aerosol. On the other hand, the air inside of a structure forming chamber 14 is exhausted by an exhaust pump 18 and a substrate 16 held by a substrate holder 17 is provided therein. When the aerosol introduced from the aerosol generator 13 via the carrier pipe 12 is sprayed toward the substrate 16 from a nozzle 15, the raw material powder is accelerated by a high speed air flow, impinges on the substrate 16, and is deposited thereon.

However, in such an apparatus for fabricating a ceramic structure (film forming apparatus), there occurs a problem that the thickness of the structure formed on the substrate cannot be controlled accurately. This is because, although the thickness of the structure is controlled by adjusting the relative speed between the substrate and the nozzle in the film forming apparatus according to the AD method, actually the density of the raw material powder (aerosol density) contained in the aerosol is unstable. In order to solve such a problem, JP-P2001-348659A discloses on the first page that an amount of ceramic fine particles within the aerosol is sensed by a sensor and a signal output from the sensor is fed back to the apparatus for fabricating a ceramic structure so as to generate an aerosol containing many primary particles of ceramic in an amount stable over time and adjust the deposition height of the ceramic structure.

However, it has been known that the aerosol density and the film forming speed are not in proportion strictly. In the AD method, during carriage of the generated aerosol, the micro powder of the raw material (primary particles) is agglomerated by the electrostatic force or the like, and, for example, agglomerated particles (secondary particles) having a diameter of several micrometers or more are formed. Such an agglomeration of particles occurs more easily as the aerosol density is higher. However, such agglomerated particles cannot contribute to the film formation because kinetic energy of the agglomerated particles is consumed for crushing themselves. Accordingly, when the aerosol density is the same, the film forming speed differs depending on the ratio between the primary particles that contribute to film formation and the secondary particles that do not contribute to the film formation contained in the aerosol. Here, the ratio cannot be controlled. Therefore, according to the method of controlling the respective parts of the film forming apparatus on the basis of the consumed amount of raw material powder, the thickness of the structure cannot be controlled accurately, either.

On the other hand, Jun AKEDO et al., "Influence of Carrier Gas Conditions on Electrical and Optical Properties of Pb (Zr, Ti) $O_3$ Thin Film Prepared by Aerosol Deposition Method", Japanese Journal of Applied Physics, Vol. 40 (2001), pp. 5528–5532, Part. 1, No. 9B, September 2001, The Japan Society of Applied Physics discloses that an electric or optical phenomenon occurs at the time of film formation in the AD method.

SUMMARY OF THE INVENTION

The present invention has been achieved in view of the above-described problems. An object of the present invention is, in a film forming apparatus according to the aerosol deposition method, to control the thickness of a structure to be formed accurately.

In order to solve the above-described problems, a film forming apparatus according to the present invention includes: a container in which raw material powder is to be provided; gas introducing means for introducing a gas into the container to blow up the raw material powder thereby generating an aerosol; holding means for holding a substrate on which a structure is to be formed; a nozzle for spraying the aerosol generated in the container toward the substrate; and detecting means to be used for obtaining an amount of the raw material powder that has contributed to film formation by impinging on the substrate or the structure formed thereon from among the raw material powder contained in the aerosol sprayed from the nozzle.

According to the present invention, since the amount of primary particles that have contributed to the film formation can be obtained by using the detecting means, the film forming speed can be directly estimated. Therefore, the thickness of the structure being formed can be controlled accurately.

DESCRIPTION OF THE PREFERRED EMBODIMENTS

Figure 1:
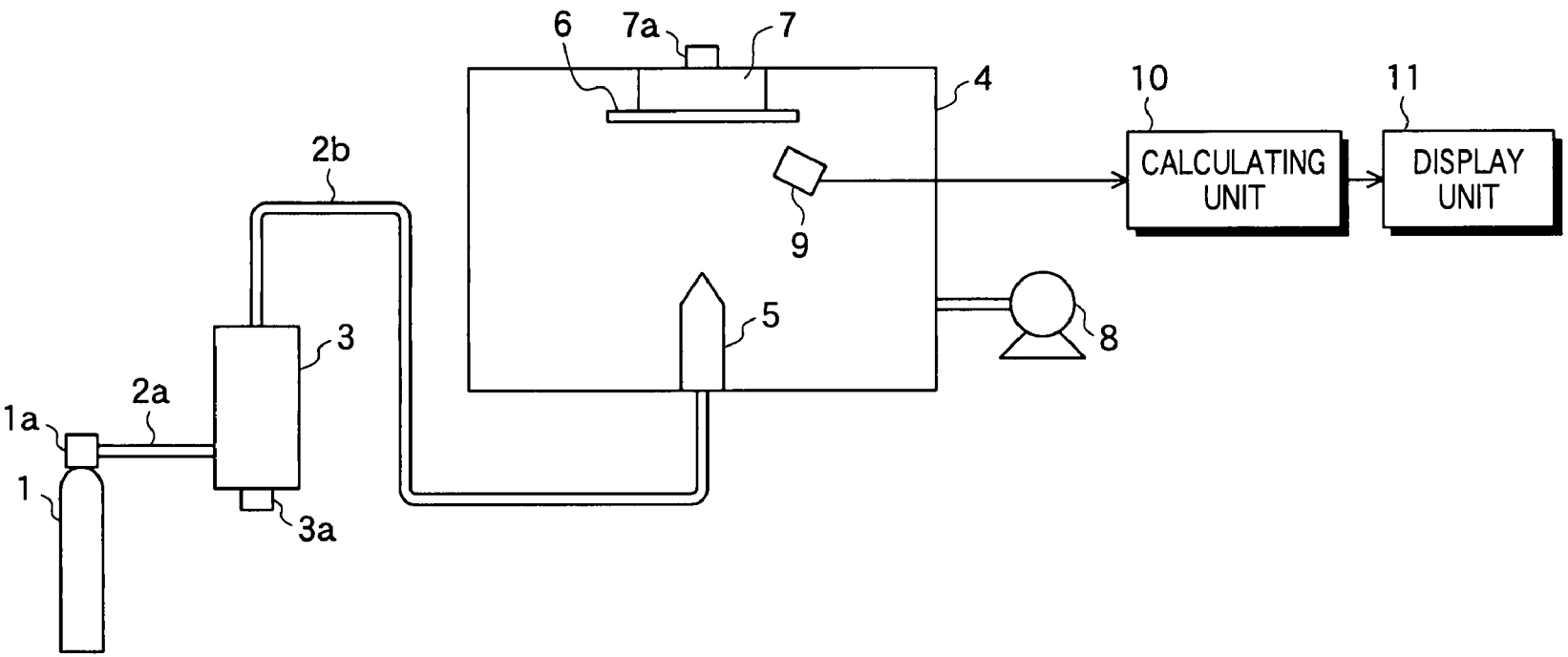
FIG. 1 is a schematic diagram showing the constitution of a film forming apparatus according to any one of the first to third embodiments of the present invention.

Hereinafter, preferred embodiments of the present invention will be described in detail by referring to the drawings. The same component elements are assigned with the same reference numerals and the description thereof will be omitted.

FIG. 1 is a schematic diagram showing a film forming apparatus according to the first embodiment of the present invention. The film forming apparatus includes a compressed gas cylinder 1, carrier pipes 2*a* and 2*b*, an aerosol generating part 3, a film forming chamber 4 in which film formation is performed, a nozzle 5 disposed in the film forming chamber 4, a substrate holder 7, an exhaust pump 8, a sensor 9, a calculating unit 10, and a display unit 11.

The compressed gas cylinder 1 is filled with nitrogen ($N_2$) to be used as a carrier gas. Further, in the compressed gas cylinder 1, there is provided a pressure regulating part 1*a* for regulating an amount of the carrier gas to be supplied. As the carrier gas, oxygen ($O_2$), helium (He), argon (Ar), dry air, and so on may be used other than that.

The aerosol generating part 3 is a container in which micro powder of a raw material as a film forming material is provided. By introducing the carrier gas via the carrier pipe 2*a* into the aerosol generating part 3, the row material powder provided there is blown up to generate an aerosol.

In the aerosol generating part 3, there is provided a container driving part 3*a* for providing micro vibration or relatively slow motion to the aerosol generating part 3. Here, the raw material powder (primary particles) provided in the aerosol generating part 3 is agglomerated by the electrostatic force, Van der Waals force, or the like as time passes to form agglomerated particles. Among the particles, giant particles of several micrometers to several millimeters are also large in mass and collect at the bottom of the container. If they collect near an exit of the carrier gas (near an exit of the carrier pipe 2*a*), the primary particles cannot be blown up by the carrier gas. Accordingly, in order not to allow the agglomerated particles to collect at one place, the container driving part 3*a* provides vibration or the like to the aerosol generating part 3 so as to agitate the powder provided within the aerosol generating part 3.

The nozzle 5 sprays the aerosol supplied from the aerosol generating part 3 via the carrier pipe 2*b* toward the substrate 6 at high speed. The nozzle 5 has an opening on the order of 5 mm in length and 0.5 mm in width.

The substrate holder 7 holds the substrate 6. Further, in the substrate holder 7, there is provided a substrate holder driving part 7*a* for moving the substrate 6 in a three-dimensional manner. Thereby, the relative position and the relative speed between the nozzle 5 and the substrate 6 are controlled.

The exhaust pump 8 exhausts the air within the film forming chamber 4 so as to hold a predetermined degree of vacuum.

The sensor 9 detects electrons emitted from the vicinity of the substrate 6. As the sensor 9, for example, a Faraday cup for measuring charged particles as current, a semiconductor detector disclosed in Yasuhiro TOKISAKI "Manufacture of Simultaneous Counting Device of Emission Secondary Electrons and Emission Secondary ions in Collision of Multiply-charged Ion on Solid Surface" (http://www.ils.uec.ac.jp/99y/B-y/Tokisaki-y.pdf, searched on Sep. 29, 2003), and so on can be used.

The calculating unit 10 performs calculating based on a detection result of the sensor 9 for estimating an amount of the powder that has contributed to the film formation, the film forming speed, and a film thickness obtained by dividing the time integration of the film forming speed by the film formation area. The film formation area is obtained by the product of the nozzle width and the moving distance of the nozzle.

The display unit 11 includes a display screen such as a CRT, an LCD, or the like, and displays the estimated values of the film forming speed, the formed film thickness, etc. obtained by the calculating unit 10. Further, the display unit 11 may display the detection results of the sensor 9 on the screen.

Figure 2:
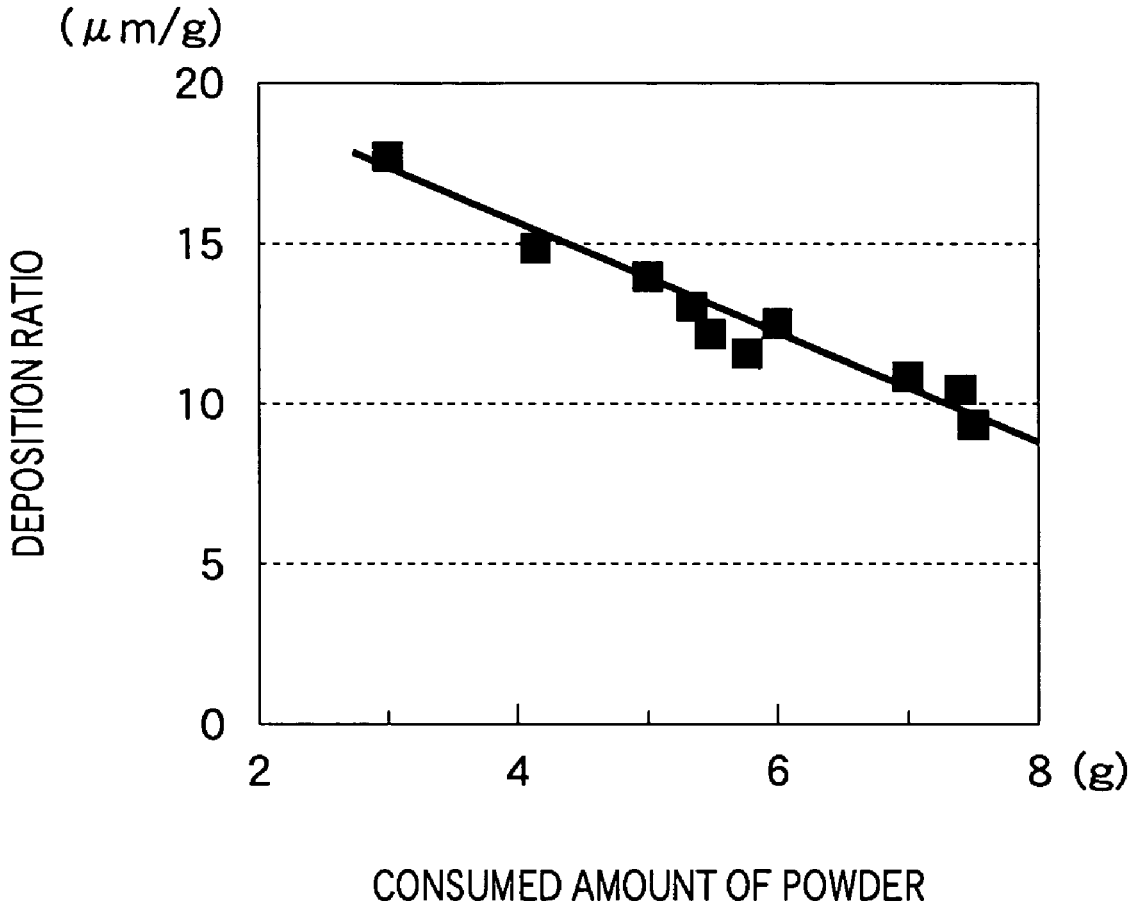
FIG. 2 shows a relationship between the consumed amount of raw material powder and the deposition rate of a structure.

Here, the reason why the sensor 9 for detecting electrons is provided in this embodiment will be described. FIG. 2 shows a relationship between the amount of the raw material powder (g) consumed within a given time and the deposition rate (μm/g) of the structure in the AD method. The deposition rate is expressed by (the thickness of the structure deposited in a given time)/(the amount of the raw material powder consumed within the given time). As shown in FIG. 2, the deposition rate becomes lower as the consumed amount of raw material powder increases, and therefore, it is understood that the film forming speed is not simply in proportion to the consumed amount of raw material powder. It is thought that this is because the larger the consumed amount of raw material powder, that is, the higher the aerosol density, the more easily the raw material powder are agglomerated to produce the agglomerated particles, and as a result, the lower the ratio of the primary particles that will contribute to the film formation becomes. Therefore, the film forming speed cannot be controlled accurately only by measuring the consumed amount of raw material powder.

Accordingly, in this embodiment, the sensor 9 is provided for estimating the density of the primary particles contained in the aerosol. Here, as disclosed in Jun AKEDO et al., "Influence of Carrier Gas Conditions on Electrical and Optical Properties of $Pb(Zr,Ti)O_3$ Thin Film Prepared by Aerosol Deposition Method", Japanese Journal of Applied Physics, Vol. 40 (2001), pp. 5528–5532, Part. 1, No. 9B, September 2001, The Japan Society of Applied Physics, it is known that a discharge phenomenon occurs when a brittle material such as ceramic is crushed. Since the AD method is a film forming method of allowing the primary particles that has been accelerated at high speed to impinge on a substrate or a structure formed thereon (hereinafter, referred to as a substrate or the like) and crushing them to join the thus formed fine fragment particles having newly emerged surfaces to the substrate or the like, such a discharge phenomenon also occurs during film formation by the AD method. Accordingly, in this embodiment, the amount of the primary particles that have actually contribute to the film formation is obtained by detecting the number (amount) of the electrons (secondary electrons) emitted due to the crush of the primary particles, and the film forming speed is estimated based on the result. Note that the structure formed on the substrate refers to a film forming material that has been deposited on the substrate previously, or a layer that has been formed previously in the case where plural layers are laminated.

On the other hand, the agglomerated particles that have been produced by the agglomeration of the primary particles are only crushed when they impinge on the substrate or the like, and they never emit electrons nor adhere to the substrate or the like to form a film.

Next, the operation of the film forming apparatus shown in FIG. 1 will be described.

First, the substrate 6 of glass or silicon dioxide ($SiO_2$), for example, is placed on the substrate holder 7 of the film forming chamber 4, and the air inside of the film forming chamber 4 is exhausted by using the exhaust pump 8 to a determined degree of vacuum. Then, a powder of PZT (Pb (lead) zirconate titanate) having an average particle diameter of 0.3 μm, for example, is placed in the aerosol generating part 3, and a carrier gas such as nitrogen is supplied from the compressed gas cylinder via the carrier pipe 2*a*. Thereby, the raw material powder is blown up to generate an aerosol in the aerosol generating part 3. The aerosol is supplied to the nozzle 5 via the carrier pipe 2*b* and sprayed toward the substrate 6 from the nozzle 5.

Thereby, the primary particles contained in the PZT powder impinge on the substrate or the like, are crushed, and adhere to the substrate or the like to form a film. At that time, by using the sensor 9, the amount of secondary electrons emitted from the crushed primary particles is detected. On the basis of a detection result of the sensor 9, the calculating unit 10 converts the detected amount of released secondary electrons into an amount of crushed primary particles, and estimates the film forming speed on the basis of the amount of crushed primary particles.

The detection result of the sensor 9, the estimated value or the like that has been calculated by the calculating unit 10 is displayed on the screen of the display unit 11. An operator can adjust the operation of the respective parts by referring to the displayed estimated values or the like so as to change the film forming speed according to need. For example, in order to increase the film forming speed, the pressure regulating part 1*a* may be controlled to increase the amount and the flow rate of the carrier gas introduced from the compressed gas cylinder so as to increase the flow volume and the speed of the aerosol sprayed from the nozzle 5. Alternatively, the container driving part 3*a* may be controlled to make the aerosol density higher by agitating the raw material powder placed in the aerosol generating part 3. Alternatively, the substrate holder driving part 7*a* may be controlled to make the relative speed between the nozzle 5 and the substrate 6 lower. Further, the operator can continue the film formation while watching the screen of the display unit 11 or stop the film formation when estimated that the film thickness reaches the necessary thickness.

As described above, according to this embodiment, since the emitted amount of secondary electrons generated when the primary particles are crushed is detected, the film forming speed or the like can be directly estimated. Further, by displaying the estimated values or the like that has been estimated, the film forming apparatus can be user-controlled on the basis of those values.

Next, a film forming apparatus according to the second embodiment of the present invention will be described by referring to FIG. 1. In the film forming apparatus according to this embodiment, a photoelectric converter is used as the sensor 9 as shown in FIG. 1. Other constitution is the same as that in the first embodiment of the present invention.

As shown in FIG. 1, by spraying the aerosol from the nozzle 5 toward the substrate, the primary particles impinge on the substrate or the like and are deposited. At that time, secondary electrons emitted from the crushed primary particles excite the carrier gas near the substrate 6 to emit light. Accordingly, the amount of primary particles can be obtained by detecting the emitted light, and the film forming speed can be estimated based on the amount of primary particles. The discharge phenomenon and light emission phenomenon accompanying the crush of the primary particles are also disclosed in the above described document of Jun AKEDO et al. As the photoelectric converter, a device including a photo-detecting element such as a MOS type sensor or a CCD can be used, and, in this embodiment, a multi-channel detector "PMA-11" manufactured by Hamamatsu Photonics K. K. is used (http://www.hpk.co.jp/Jpn/products/SYS/Pma11J.htm, searched on Sep. 29, 2003).

Next, a film forming apparatus according to the third embodiment of the present invention will be described by referring to FIG. 1. In the film forming apparatus according to this embodiment, a color sensor is used as the sensor 9 as shown in FIG. 1. Other constitution is the same as that in the first embodiment of the present invention.

Here, as described above, at the time of film formation, secondary electrons are generated in response to the amount of the crushed primary particles, and the discharge phenomenon occurs due to the secondary electrons. In the case where the number of secondary electrons is large, sometimes oxide ceramic such as a piezoelectric material including PZT is reduced by the discharge and oxygen deficiency occurs in the crystal. In such a case, the surface of the structure during film formation takes on black color. Accordingly, the film forming speed can be estimated by detecting the surface color of the formed structure by using the color sensor and obtaining the amount of primary particles that have contributed to the film formation based on the detection result. In the case where the structure is a piezoelectric material, because the oxygen deficiency causes the deterioration of the piezoelectric characteristics, such a state is desirably avoided. Therefore, the film forming speed may be adjusted so as to decrease the oxygen deficiency by controlling the respective parts based on the detection result of the color sensor. The change of the surface color of the structure that has been formed by the AD method is also disclosed in the above described document of Jun AKEDO et al.

As the sensor for detecting the surface color of the structure, for example, a detecting device used in a color sensor "TEN-16" developed by LENTEK (http//www.lentec.co.jp/pic/color.htm, searched on Sep. 29, 2003) can be used. Further, by combining the sensor used in this embodiment with the film forming apparatus according to the first or second embodiment of the present invention, both the film forming speed and the stoichiometry can be satisfied.

Figure 3:
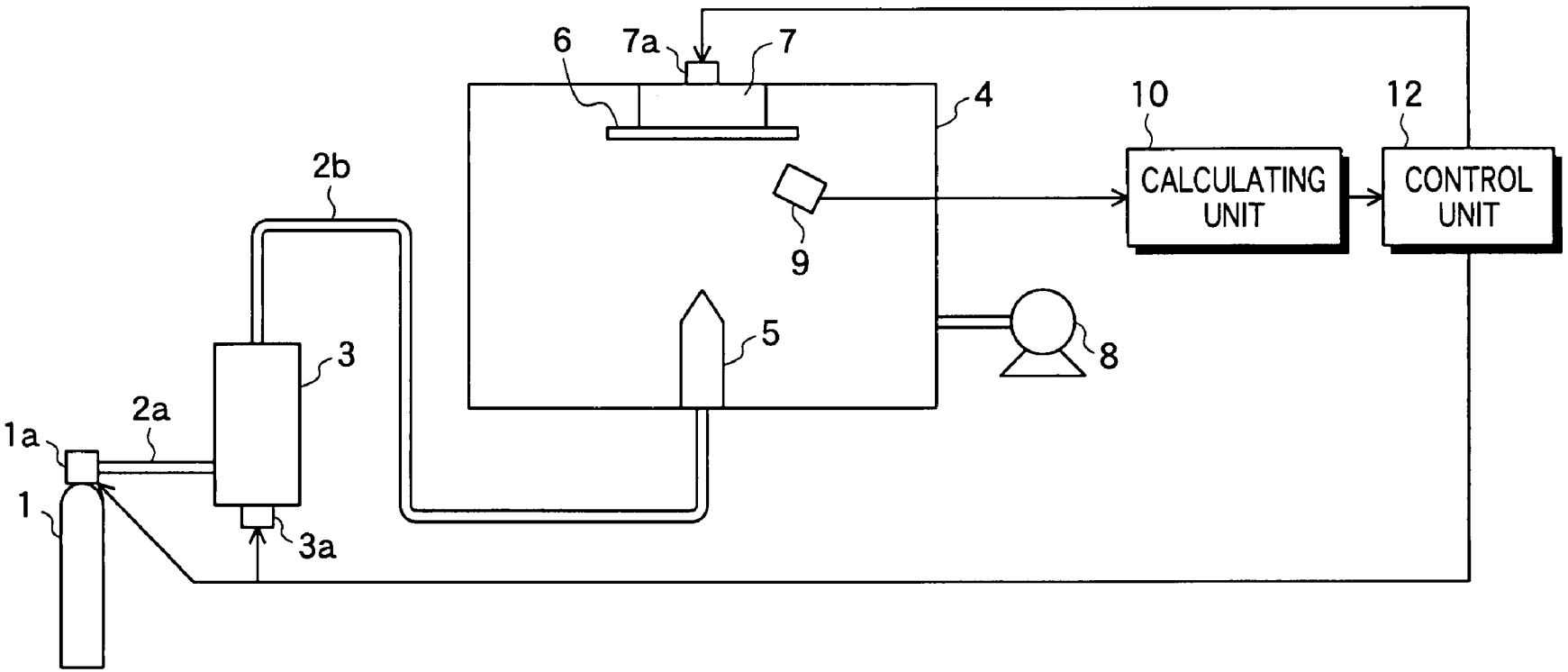
FIG. 3 is a schematic diagram showing the constitution of a film forming apparatus according to the fourth embodiment of the present invention.

Next, a film forming apparatus according to the fourth embodiment of the present invention will be described. FIG. 3 is a schematic diagram showing the constitution of the film forming apparatus according to the fourth embodiment. As shown in FIG. 3, the film forming apparatus has a control unit 12 in place of the display unit 11 as shown in FIG. 1. Other constitution is the same as in the film forming apparatus as shown in FIG. 1.

The control unit 12 controls the operation of the respective parts of the film forming apparatus based on the estimated values of film forming speed or the like obtained by the calculating unit 10. That is, the control unit 12 controls the pressure regulating part 1*a* to change the flow volume of the carrier gas, controls the container driving part 3*a* to adjust the aerosol density, and controls the substrate holder driving part 7*a* to adjust the speed of the nozzle 5 to the substrate 6 so as to obtain the preset or suitable film forming speed. Thus, the thickness of a structure to be formed can be controlled accurately by feeding back the estimated amount such as the film forming speed to the respective parts of the film forming apparatus.

Further, as a modified example of the film forming apparatus according to this embodiment, the display unit 11 as shown in FIG. 1 may be provided. In this case, both the automatic control by the control unit 12 and the user control by referring to the screen of the display unit 11 can be performed.

Furthermore, as the sensor 9 in this embodiment, the photoelectric converter explained in the second embodiment, the color sensor explained in the third embodiment, or a combination thereof can be used.

The invention claimed is:

1. A film forming apparatus comprising:

aerosol generating means for dispersing raw material powder in a gas, thereby generating an aerosol;

holding means for holding a substrate on which a structure is to be formed;

a nozzle for spraying the aerosol generated by said aerosol generating means toward said substrate; and detecting means for obtaining after contact an amount of the raw material powder that has contributed to film formation by impinging on one of said substrate and the structure formed thereon, by detecting a result of crushing of the raw material powder contained in the aerosol sprayed from said nozzle.

2. The film forming apparatus according to claim 1, further comprising:

calculating means for calculating at least one of a film forming speed and a formed film thickness on the basis of the amount of the raw material powder that has contributed to the film formation obtained by using said detecting means.

3. The film forming apparatus according to claim 2, further comprising:

displaying means for displaying the at least one of the film forming speed and the formed film thickness calculated by said calculating means.

4. The film forming apparatus according to claim 1, further comprising:

controlling means for controlling a forming speed of the structure being formed on said substrate on the basis of a detection result of said detecting means.

5. The film forming apparatus according to claim 4, wherein said controlling means controls said holding means to change a relative speed between said nozzle and said substrate.

6. The film forming apparatus according to claim 1, wherein said aerosol generating means includes:

a container in which the raw material powder is to be provided; and gas introducing means for introducing the gas into said container to blow up the raw material powder thereby generating an aerosol.

7. The film forming apparatus according to claim 6, further comprising:

controlling means for controlling a forming speed of the structure being formed on said substrate on the basis of a detection result of said detecting means.

8. The film forming apparatus according to claim 7, wherein said controlling means controls said gas introducing means to adjust one of an amount and a speed of the gas introduced into said container so as to change one of an amount and a speed of the aerosol sprayed from said nozzle.

9. The film forming apparatus according to claim 7, further comprising:

driving means for providing said container with at least one of vibration and predetermined motion;

wherein said controlling means controls said driving means to agitate the raw material powder provided in said container so as to change the amount of raw material powder contained in the aerosol supplied to said nozzle.

10. A film forming apparatus, comprising:

aerosol generating means for dispersing raw material powder in a gas thereby generating an aerosol;

holding means for holding a substrate on which a structure is to be formed;

a nozzle for spraying the aerosol generated by said aerosol generating means toward said substrate; and detecting means for obtaining an amount of the raw material powder that has contributed to film formation by impinging on one of said substrate and the structure formed thereon, by detecting a result of crushing of the raw material powder contained in the aerosol sprayed from said nozzle;

wherein said detecting means detects an amount of electrons generated by the raw material powder impinging on one of said substrate and the structure formed thereon and being crushed.

11. A film forming apparatus comprising:

aerosol generating means for dispersing raw material powder in a gas, thereby generating an aerosol;

holding means for holding a substrate on which a structure is to be formed;

a nozzle for spraying the aerosol generated by said aerosol generating means toward said substrate; and detecting means for obtaining after contact an amount of the raw material powder that has contributed to film formation by impinging on one of said substrate and the structure formed thereon, by detecting a result of crushing of the raw material powder contained in the aerosol sprayed from said nozzle, wherein said detecting means detects color of the structure formed on said substrate.

12. A film forming apparatus, comprising:

aerosol generating means for dispersing raw material powder in a gas thereby generating an aerosol;

holding means for holding a substrate on which a structure is to be formed;

a nozzle for spraying the aerosol generated by said aerosol generating means toward said substrate; and detecting means for obtaining an amount of the raw material powder that has contributed to film formation by impinging on one of said substrate and the structure formed thereon, by detecting a result of crushing of the raw material powder contained in the aerosol sprayed from said nozzle;

wherein said detecting means detects intensity of discharge generated when the raw material powder impinges on one of said substrate and the structure formed thereon and is crushed.

13. The film forming apparatus according to claim 12, further comprising:

calculating means for calculating at least one of a film forming speed and a formed film thickness on the basis of the amount of the raw material powder that was contributed to the film formation obtained by using said detecting means.

14. The film forming apparatus according to claim 13, further comprising:

displaying means for displaying the at least one of the film forming speed and the formed film thickness calculating by said calculating means.

15. The film forming apparatus according to claim 12, further comprising:

controlling means for controlling a forming speed of the structure being formed on said substrate on the basis of a detection result of said detecting means.

16. The film forming apparatus according to claim 15, wherein said controlling means controls said holding means to change a relative speed between said nozzle and said substrate.

17. The film forming apparatus according to claim 12, wherein said aerosol generating means includes:

a container in which the raw material powder is to be provided; and gas introducing means for introducing the gas into said container to blow up the raw material powder thereby generating an aerosol.

18. The film forming apparatus according to claim 17, further comprising:

controlling means for controlling a forming speed of the structure being formed on said substrate on the basis of a detection result of said detecting means.

19. The film forming apparatus according to claim 18, wherein said controlling means controls said gas introducing means to adjust one of an amount and a speed of the gas introduced into said container so as to change one of an amount and a speed of the aerosol sprayed from said nozzle.

20. The film forming apparatus according to claim 18, further comprising:

driving means for providing said container with a least one of vibration and predetermined motion;

wherein said controlling means controls said driving means to agitate the raw material powder provided in said container so as to change the amount of raw material powder contained in the aerosol supplied to said nozzle.

* * * * *